US012286277B1

(12) United States Patent
Bigelow

(10) Patent No.: US 12,286,277 B1
(45) Date of Patent: Apr. 29, 2025

(54) DOUBLE-ENDED CONTAINER WITH REMOVABLE LID HAVING PEELABLE INSERT

(71) Applicant: Lindsay Bigelow, Apex, NC (US)

(72) Inventor: Lindsay Bigelow, Apex, NC (US)

( * ) Notice: Subject to any disclaimer, the term of this patent is extended or adjusted under 35 U.S.C. 154(b) by 0 days.

(21) Appl. No.: 18/819,827

(22) Filed: Aug. 29, 2024

(51) Int. Cl.
*B65D 43/02* (2006.01)
*B65D 83/764* (2025.01)

(52) U.S. Cl.
CPC ..... *B65D 43/0235* (2013.01); *B65D 83/764* (2025.01); *B65D 2401/15* (2020.05)

(58) Field of Classification Search
CPC ..... B65D 43/0235; B65D 83/0027; B65D 2401/15
USPC ..... 220/260
See application file for complete search history.

(56) References Cited

U.S. PATENT DOCUMENTS 356,188 A 1/1887 Bryant
3,815,787 A * 6/1974 Spies ..... B65D 83/0027 222/492
4,760,784 A * 8/1988 Whiteside ..... B30B 9/3028 53/526
7,866,500 B1 * 1/2011 Peggs ..... B65D 41/04 220/666
8,061,548 B1 * 11/2011 Peggs ..... B65D 83/04 220/666
2007/0272698 A1 11/2007 Brown et al.
2008/0149661 A1 * 6/2008 Sines ..... B65D 83/0005 221/279
2009/0039112 A1 * 2/2009 Robertson ..... B65D 83/0005 222/326
2012/0074174 A1 * 3/2012 Pollack ..... B65D 83/0005 222/386
2012/0103988 A1 * 5/2012 Wiening ..... B65D 51/20 220/260
2013/0313258 A1 * 11/2013 Sines ..... B65D 83/0083 220/780
2014/0131366 A1 * 5/2014 Lim ..... B65D 81/3216 220/592.17
2014/0175131 A1 * 6/2014 Abrams ..... B65D 83/0027 222/405
2015/0014365 A1 1/2015 Smith et al.
2016/0340105 A1 * 11/2016 Koz ..... B65D 83/0027
2016/0368663 A1 * 12/2016 Hizon ..... A47G 19/12
2018/0086543 A1 3/2018 Van Why

* cited by examiner

*Primary Examiner* — J. Gregory Pickett
*Assistant Examiner* — Niki M Eloshway

(57) ABSTRACT

Herein disclosed is a double-ended container having a length separating a top opening from a bottom opening, an interior surface comprising a groove disposed in the length, a top removable lid configured to removably retain a peelable insert, and a bottom removable lid. The groove may be a straight groove or a spiral groove. The insert may comprise a surface tab disposed on a top surface of the insert, providing handle for rotating the insert in a spiral groove. The insert may comprise a perimeter tab disposed at an edge of the insert to engage a straight groove. Engaging the straight groove with the perimeter tab may rotationally lock the insert. The groove may comprise slots offset from a groove centerline, permitting the insert to be locked in slot positions between the top and bottom. An implementation may increase efficiency of access to spreadable foods while reducing waste and contamination.

16 Claims, 8 Drawing Sheets

DOUBLE-ENDED CONTAINER WITH REMOVABLE LID HAVING PEELABLE INSERT

CROSS-REFERENCE TO RELATED APPLICATIONS

None.

TECHNICAL FIELD

This disclosure relates generally to containers for edible spreads.

BACKGROUND

A container is a receptacle for holding material. A container may be any shape or size. A container's interior may have a contiguous space for holding material. Some containers may have an interior subdivided into multiple spaces. A container may hold material within the container's interior. The container may hold material until a user opens the container. The user may release a portion of the material from the opened container. Some containers have a lid that covers an opening in the container. The lid may be removable to access material held by the container. Some containers may require cutting or puncturing to access material held by the container.

A container may hold material of any type. Material held by a container may be an edible substance such as a food spread. A container may retain an edible spread such as for example peanut butter, jam, mayonnaise or salad dressing. A user may open some containers by removing a lid. Removing the lid may provide access to the spread through an opening. The user may remove the spread through the opening using a utensil such as for example a knife, spoon or spatula.

Access to material within the container may be limited by the length of the utensil. For example, as material is removed from the container, the material within the container is depleted. As the material within the container is depleted the user may have to reach further into the container with the utensil to reach the remaining material. The user may have to use the utensil to scrape the container bottom through an opening at an end of the container opposite the bottom.

Scraping the container bottom through an opening at the opposite end of the container may be ineffective to reach the depleted material. Such ineffective content removal may result in wasting valuable content. In some cases, to access spread remaining within the container, a user may awkwardly place their hand holding a utensil into the container, risking contamination of the container contents. Accessing material within a singled-ended container may require significant effort while exposing a user to substantial risk of contamination and wasted contents.

SUMMARY

Herein disclosed is a double-ended container having a length separating a top opening from a bottom opening, an interior surface comprising a groove disposed in the length, a top removable lid configured to removably retain a peelable insert, and a bottom removable lid. The groove may be a straight groove or a spiral groove. The insert may comprise a surface tab disposed on a top surface of the insert, providing handle for rotating the insert in a spiral groove. The insert may comprise a perimeter tab disposed at an edge of the insert to engage a straight groove. Engaging the straight groove with the perimeter tab may rotationally lock the insert. The groove may comprise slots offset from a groove centerline, permitting the insert to be locked in slot positions between the top and bottom. An implementation may increase efficiency of access to spreadable foods while reducing waste and contamination.

BRIEF DESCRIPTION OF THE DRAWINGS

The details of various implementations are set forth in the drawings and the description below. Other features and advantages will be apparent from the description and drawings, and from the claims. Like reference symbols in the various drawings indicate like elements.

DETAILED DESCRIPTION

FIGS. 1A-1F depict an illustrative operational scenario wherein a user employs a double-ended container with an insert removed from a container lid to force an edible spread through a secondary opening as the spread within the container is depleted. In the exemplary operational scenario 100 depicted by FIGS. 1A-1F, a user employs the double-ended container 110 to access an edible spread. In the depicted implementation, the double-ended container 110 is configured to receive the top removable lid 115*a*. In the depicted implementation, the double-ended container 110 is configured with the top opening 115*b*. In the depicted implementation, the top removable lid 115*a* is configured to close the top opening 115*b*. The top removable lid 115*a* and the top opening 115*b* may have screw threads configured to open and close the top opening 115*b* by screwing and unscrewing the top removable lid 115*a* and the top opening 115*b*. The top removable lid 115*a* and the top opening 115*b* may be configured with a latch mechanism or a snap-fit design for releasably engaging the top removable lid 115*a* and the top opening 115*b*. In the depicted implementation, the bottom removable lid 120*a* is configured to close the bottom opening 120*b*. The bottom removable lid 120*a* and the bottom opening 120*b* may have screw threads configured to open and close the bottom opening 120*b* by screwing and unscrewing the bottom removable lid 120*a* and the bottom opening 120*b*. The bottom removable lid 120*a* and the bottom opening 120*b* may be configured with a latch mechanism or a snap-fit design for releasably engaging the bottom removable lid 120*a* and the bottom opening 120*b*. In the implementation depicted by FIGS. 1A-1F, the top removable lid 115*a* is configured to retain the insert 125. In the depicted implementation the insert 125 is a removable insert. The insert 125 may be a peelable insert. The peelable insert 125 may be adhered to the top removable lid 115*a* by an adhesive. The insert 125 may be removable from the top removable lid 115*a* by peeling the insert 125 from the top removable lid 115*a*.

Figure 1A:
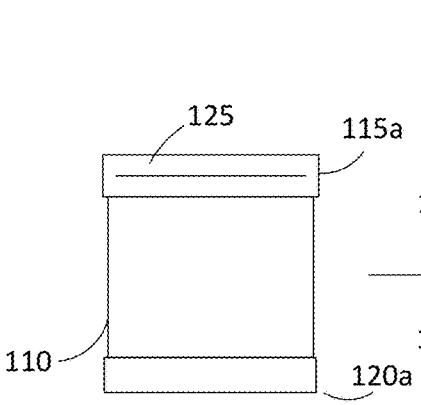
FIGS. 1A-1F depict an illustrative operational scenario wherein a user employs a double-ended container with an insert removed from a container lid to force an edible spread through a secondary opening as the spread within the container is depleted.

In FIG. 1A, the user approaches the double-ended container 110. In the depicted implementation, the double-ended container 110 is a peanut butter jar. In the exemplary operational scenario 100, the double-ended container 110 retains peanut butter.

Figure 1B:
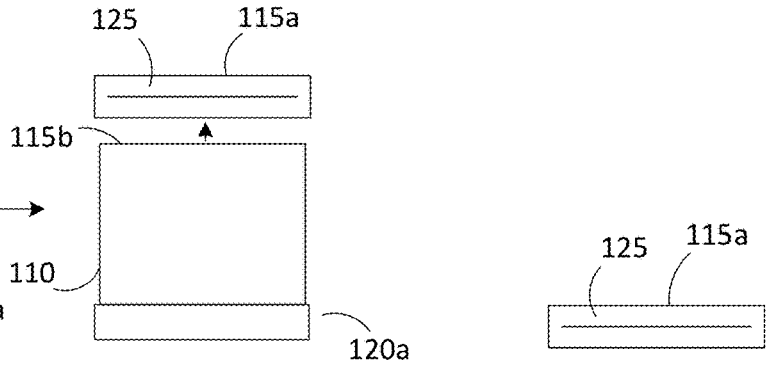

In FIG. 1B, the user removes the top removable lid 115*a* from the double-ended container 110 top opening 115*b*. In the depicted implementation, the top removable lid 115*a* retains the insert 125. In the illustrated example, the user sets aside the top removable lid 115*a* with the insert 125 retained within the top removable lid 115*a*.

Figure 1C:
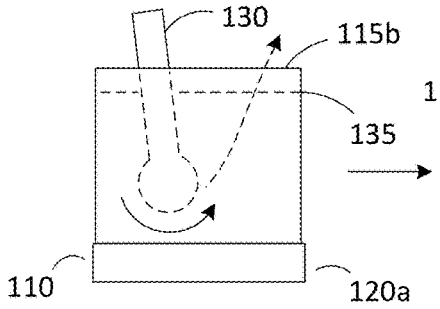

In FIG. 1C, the user removes peanut butter from the double-ended container 110 using the utensil 130. The utensil 130 may be a spoon. The utensil 130 may be a knife. The utensil 130 may be a spatula. In the scenario depicted by FIG. 1C, the user begins removing peanut butter from the double-ended container 110 at the initial spread level 135.

Figure 1D:
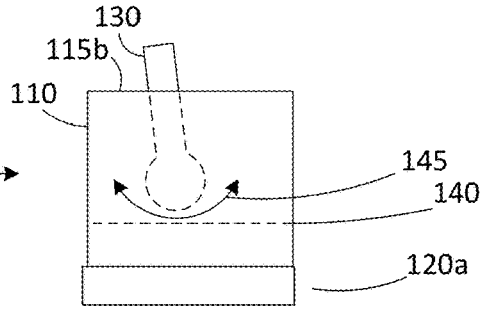

In FIG. 1D, the amount of peanut butter within the double-ended container 110 has been reduced to the depleted spread level 140. In the scenario depicted by FIG. 1D, access to the peanut butter at the depleted spread level 140 is constrained by the length of the utensil 130. The user may extend their hands into the double-ended container 110 through the top opening 115*b* in an attempt to reach the peanut butter. The user may move the utensil 130 back and forth within the double-ended container 110 with a swinging motion 145 in an attempt to access the peanut butter. Extending hands into the double-ended container 110 or swinging the utensil 130 within the double-ended container 110 risks making a mess and/or contaminating the peanut butter within the double-ended container 110, while failing to access the peanut butter.

Figure 1E:
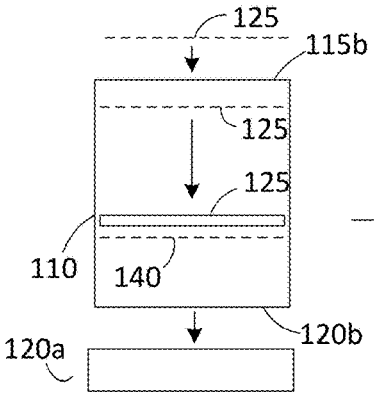

In FIG. 1E, the user removes the bottom removable lid 120*a* from the double-ended container 110 bottom opening 120*b*. In the illustrated example, the user sets aside the bottom removable lid 120*a*. In the scenario depicted by FIG. 1E, the user removes the insert 125 from the top removable lid 115*a* (depicted at least by FIG. 1B). In the depicted implementation, the insert 125 is a peelable insert. In the scenario depicted by FIGS. 1E, the user positions the insert 125 into the top opening 115*b* of the double-ended container 110. In the illustrated example, the pushes the insert 125 into the double-ended container 110 through the top opening 115*b* toward the depleted spread level 140.

Figure 1F:
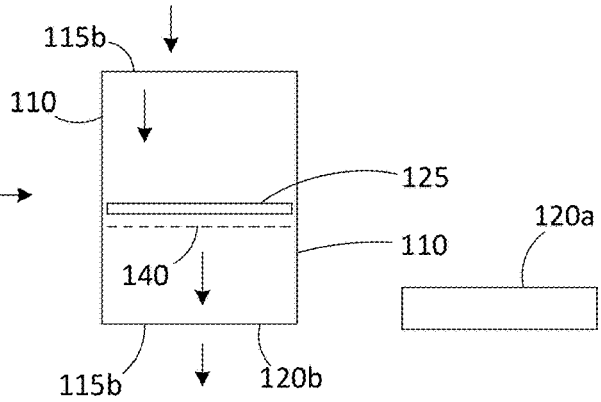

In FIG. 1F, the user forces the peanut butter from the double-ended container 110 out of the bottom opening 120*b* using the insert 125. The user may force the peanut butter from the double-ended container 110 by pressing on the insert 125 with a finger or a utensil. The insert may be configured with a tab of various designs disclosed herein to permit the user to force the peanut butter from the double-ended container 110 using the insert 125.

In an alternative implementation with reference to FIGS. 1A-1F, the removable insert 125 may be configured in the bottom removable lid 120*a*. In this alternative implementation, the user may initially remove and set aside the top removable lid 115*a*, to remove the contents of the double-ended container 110 through the top opening 115*b* using the utensil 130. Upon removing enough of the contents to reach the depleted spread level 140, the user may then remove the bottom removable lid 120*a*. Then, the user may peel the removable insert 125 from the bottom removable lid 120*a*. Then, the user may place the insert 125 into the double-ended container 110 through the bottom opening 120*b* and use the insert 125 to force contents from the double-ended container 110 out of the top opening 115*b*.

FIGS. 2A-2F depict various views of exemplary insert implementations configured for using an insert removed from a container lid to force an edible spread through a secondary container opening as a spread within the container is depleted. The insert 125 depicted by FIGS. 2A-2F may be a peelable insert. The insert 125 depicted by FIGS. 2A-2F may comprise a planar structure. The insert 125 depicted by FIGS. 2A-2F may comprise a semi-rigid planar structure. The insert 125 depicted by FIGS. 2A-2F may comprise a circular, elliptical or rectangular planar surface. The insert 125 depicted by FIGS. 2A-2F comprises an edge defining a perimeter of the planar surface.

Figure 2A:
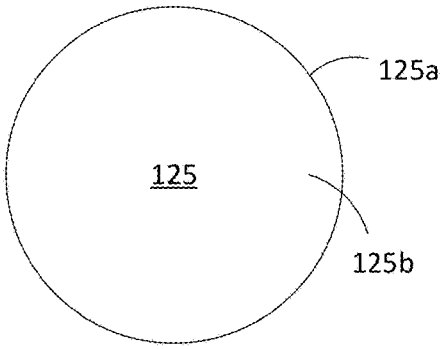
FIGS. 2A-2F depict various views of exemplary insert implementations configured for using an insert removed from a container lid to force an edible spread through a secondary container opening as a spread within the container is depleted.

FIG. 2A depicts a top view of the exemplary insert 125. In FIG. 2A, the insert 125 comprises the edge 125*a*. In FIG. 2A, the insert 125 comprises the at least one planar surface 125*b*. In the implementation depicted by FIG. 2A, the insert 125 is substantially circular. The insert 125 may be any shape.

Figure 2B:
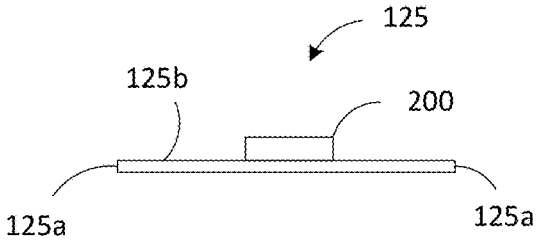

FIG. 2B depicts a side view of the exemplary insert 125. In the implementation depicted by FIG. 2B, the insert 125 comprises the collapsible surface tab 200. In FIG. 2B, the collapsible surface tab 200 is depicted configured in an exemplary collapsed mode. In the implementation depicted by FIG. 2B, the collapsible surface tab 200 extends above the at least one planar surface 125*b*. The collapsible surface tab 200 may be recessed flush with the at least one planar surface 125*b*. The collapsible surface tab 200 may comprise an opening configured as a pull tab opening (not shown). The pull tab opening may permit a user to grab or hook into the pull tab, for extending or standing up the collapsible surface tab 200 from the at least one planar surface 125*b*.

Figure 2C:
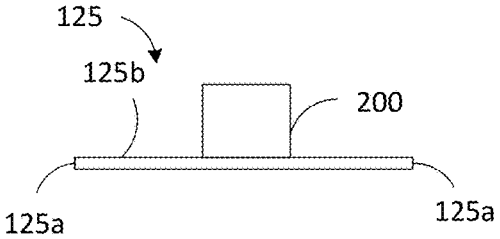

FIG. 2C depicts a side view of the exemplary insert 125 with the collapsible surface tab 200 of FIG. 2B in an exemplary extended or stood-up configuration.

Figure 2D:
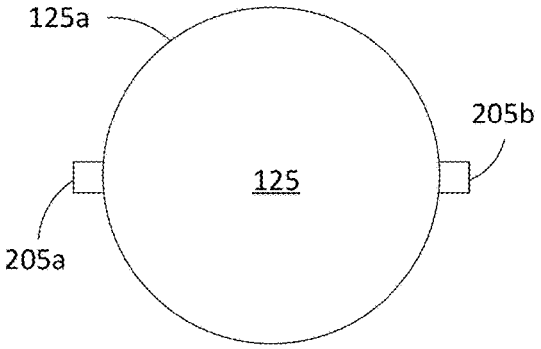

FIG. 2D depicts a top view of the exemplary insert 125 with perimeter tab 205*a* and perimeter tab 205*b* disposed in the edge 125*a* of the insert 125. The perimeter tab 205*a* and perimeter tab 205*b* may be flexible and or bendable along the edge 125*a*, permitting the insert 125 be inserted within a double-ended container 110 (depicted at least by FIGS. 1A-1F).

Figure 2E:
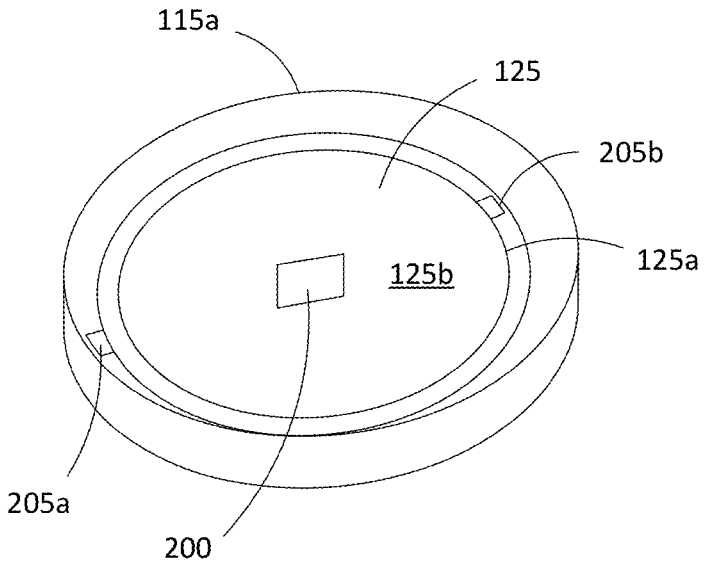

FIG. 2E depicts a top perspective view of the inside of an exemplary top removable lid 115*a*. In FIG. 2E, the top removable lid 115*a* retains the insert 125 on the inside of the top removable lid 115*a*. In the implementation depicted by FIG. 2E, the insert 125 is a removable peelable insert. The insert 125 may be retained by the top removable lid 115*a* using an adhesive. The adhesive may be a removable pressure sensitive adhesive, permitting the insert 125 to be repeatedly peeled from and replaced on the top removable lid 115*a*. In the implementation depicted by FIG. 2E, the insert 125 comprises the collapsible surface tab 200, the perimeter tab 205*a* and the perimeter tab 205*b*. In the implementation depicted by FIG. 2E, the collapsible surface tab 200 is depicted configured in an exemplary collapsed mode.

Figure 2F:
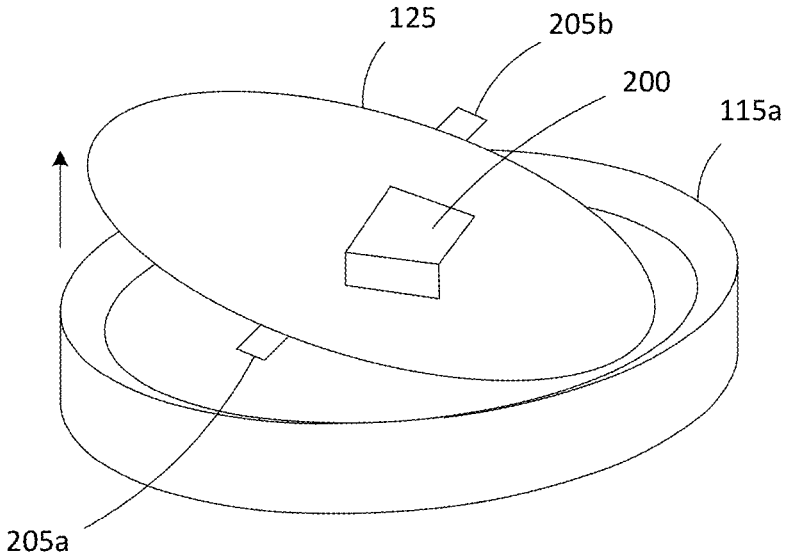

FIG. 2F depicts a front top perspective view of the inside of the exemplary top removable lid 115*a* illustrated by FIG.

2E. In FIG. 2F, the insert 125 is illustrated being peeled from the inside of the top removable lid 115*a*.

FIGS. 3A-3F depict various views of exemplary groove implementations configured to engage an exemplary insert to force an edible spread through a secondary container opening as a spread within the container is depleted.

Figure 3A:
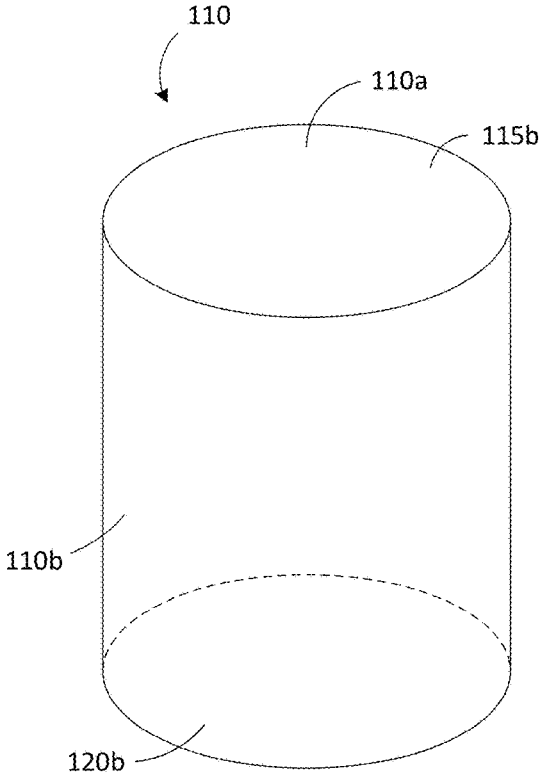
FIGS. 3A-3F depict various views of exemplary groove implementations configured to engage an exemplary insert to force an edible spread through a secondary container opening as a spread within the container is depleted.

FIG. 3A is a front perspective view of an exemplary double-ended container 110. In FIG. 3A, the exemplary double-ended container 110 includes the interior surface 110*a*, the exterior surface 110*b*, the top opening 115*b* and the bottom opening 120*b*.

Figure 3B:
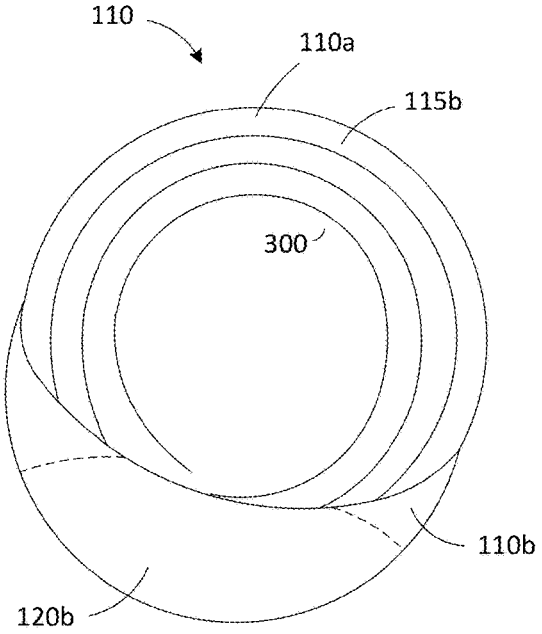

FIG. 3B is a top perspective view of an exemplary double-ended container 110. In FIG. 3B the interior surface 110*a* of the double-ended container 110 is visible through the top opening 115*b*. In FIG. 3B, the spiral groove 300 is disposed in the interior surface 110*a*.

Figure 3C:
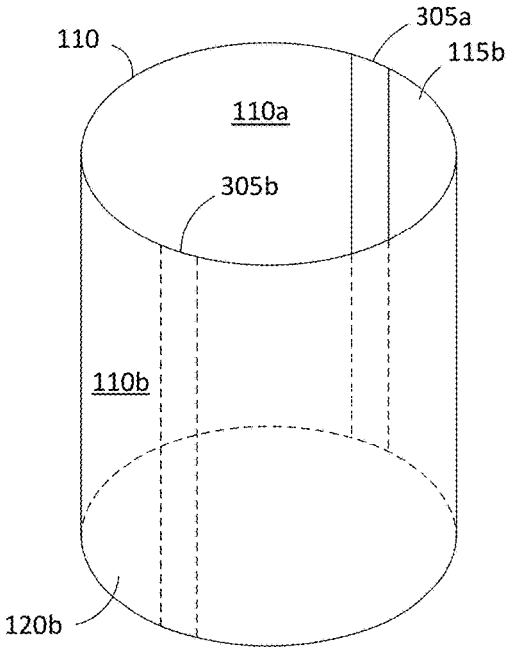

FIG. 3C is a front perspective view of an exemplary double-ended container 110. In FIG. 3C, the interior surface 110*a* is visible through the top opening 115*b* of the double-ended container 110. In FIG. 3C, the straight groove 305*a* and the straight groove 305*b* are disposed in the interior surface 110*a*. The straight groove 305*a* and the straight groove 305*b* may each engage a perimeter tab 205 (depicted at least by FIGS. 2D, 2E and 2F) permitting the insert 125 to be rotationally locked within the double-ended container 110. Rotationally locking the insert 125 within the double-ended container 110 may stabilize the insert 125 and increase the surface area of the insert 125 in contact with contents of the double-ended container 110, reducing the user's effort forcing material out of the double-ended container 110 with the insert 125.

Figure 3D:
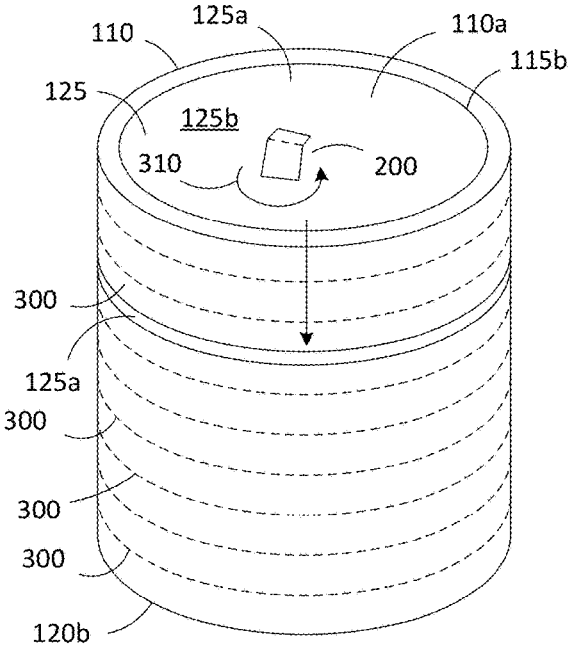

FIG. 3D is a front perspective view of an exemplary double-ended container 110. In FIG. 3D, the spiral groove 300 disposed in the interior surface 110*a* is visible in broken line from outside the double-ended container 110. In the implementation depicted by FIG. 3D, the edge 125*a* of the insert 125 engages the spiral groove 300. In the implementation depicted by FIG. 3D, the collapsible surface tab 200 is illustrated configured in an exemplary extended mode. In the example depicted by FIG. 3D, the extended collapsible surface tab 200 is available for use as a handle for turning the collapsible surface tab 200 in the spiral groove 300 with rotation 310. Turning the collapsible surface tab 200 in the spiral groove 300 using the collapsible surface tab 200 guided by the spiral groove 300 reduces the user's effort and avoids mess while forcing contents of the double-ended container 110 out of the bottom opening 120*b*. For example, guiding the collapsible surface tab 200 by the spiral groove 300 creates a barrier to material loss above the insert 125, preventing waste, contamination and mess.

Figure 3E:
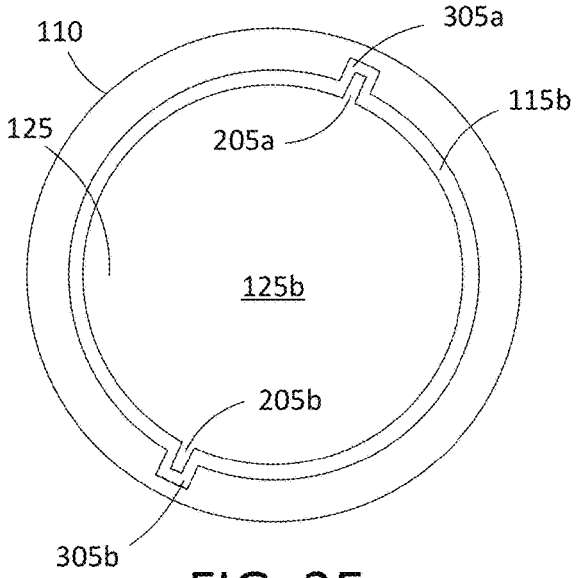

FIG. 3E is a top view of an exemplary insert 125 disposed within an exemplary double-ended container 110. In the implementation depicted by FIG. 3E, the perimeter tab 205*a* is engaged with the straight groove 305*a*. In the implementation depicted by FIG. 3E, the perimeter tab 205*b* is engaged with the straight groove 305*b*.

Figure 3F:
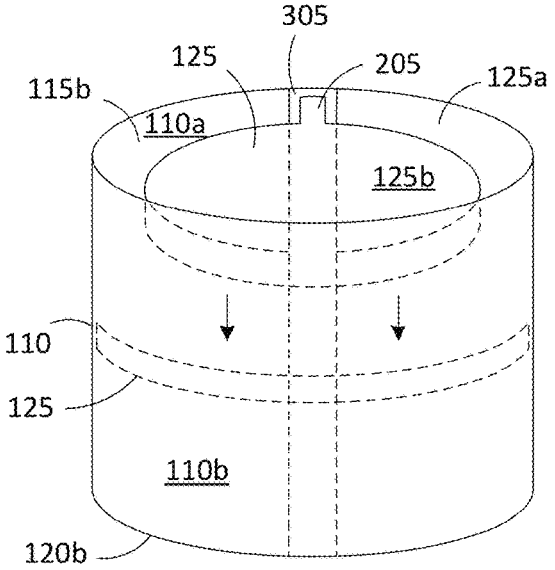

FIG. 3F is a front perspective view of an exemplary double-ended container 110 with the insert 125 illustrated moving in a downward motion toward the bottom opening 120*b*. In the implementation depicted by FIG. 3F, the insert 125 is guided by the straight groove 305 engaged with the perimeter tab 205.

Figure 4:
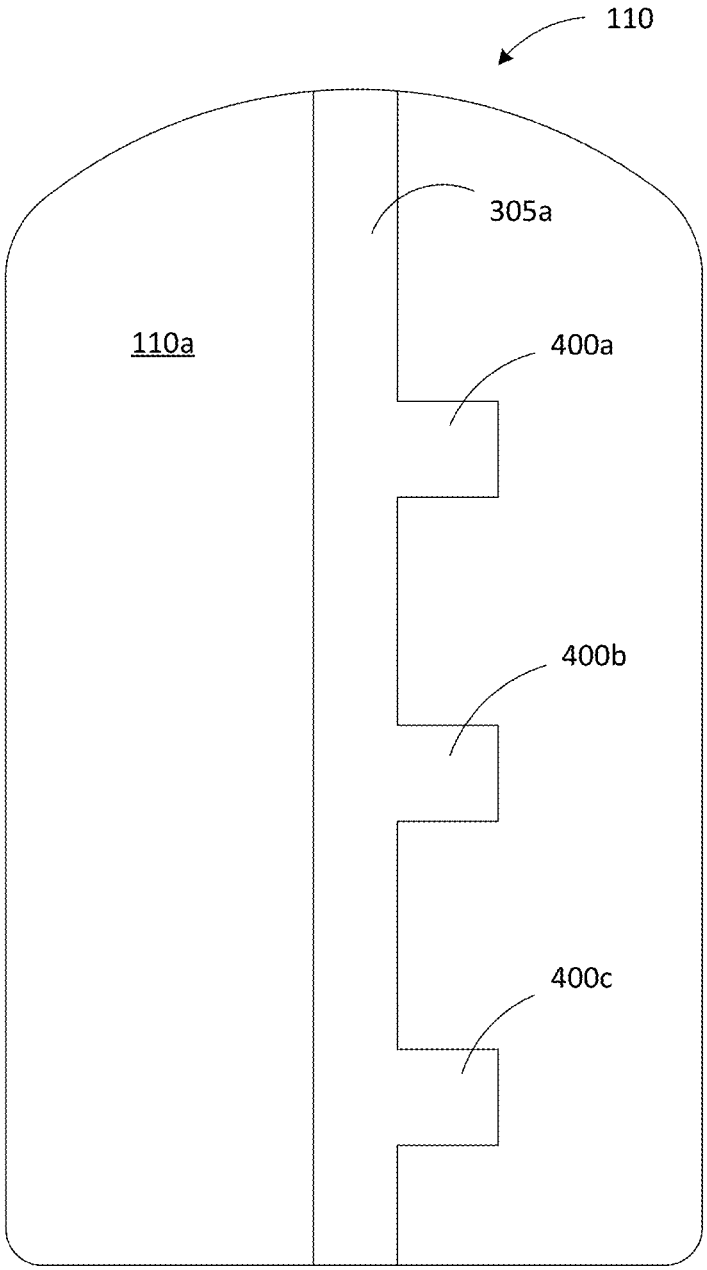
FIG. 4 depicts a cut-away view of an exemplary double-ended container interior surface illustrating an exemplary slot and groove implementation configured to rotationally lock an exemplary insert at various slot positions within the double-ended container as a spread within the container is depleted.

FIG. 4 depicts a cut-away view of an exemplary double-ended container interior surface illustrating an exemplary slot and groove implementation configured to rotationally lock an exemplary insert 125 (depicted at least by FIGS. 1A-1F) at various slot positions within the double-ended container as a spread within the container is depleted. In FIG. 4, the exemplary double-ended container 110 includes the interior surface 110*a*. In the implementation depicted by FIG. 4, the straight groove 305*a* is disposed in the interior surface 110*a*. In the implementation depicted by FIG. 4, the straight groove 305*a* is configured with a plurality of slots 400*a*, 400*b* and 400*c*. The plurality of slots 400 may be distributed along the length of the straight groove 305*a*. The plurality of slots 400 may be any number of slots 400. Rotationally locking an exemplary insert 125 at various slot positions may permit storing the double-ended container 110 with the insert 125 secured at an intermediate displacement along the length of the straight groove 305*a*. Securing the insert 125 at an intermediate displacement based on the amount of contents remaining in the double-ended container 110 may reduce a user's effort accessing the contents, by preventing the user from having to repeat forcing the insert 125 to the intermediate displacement point when re-opening the double-ended container 110.

Figure 5A:
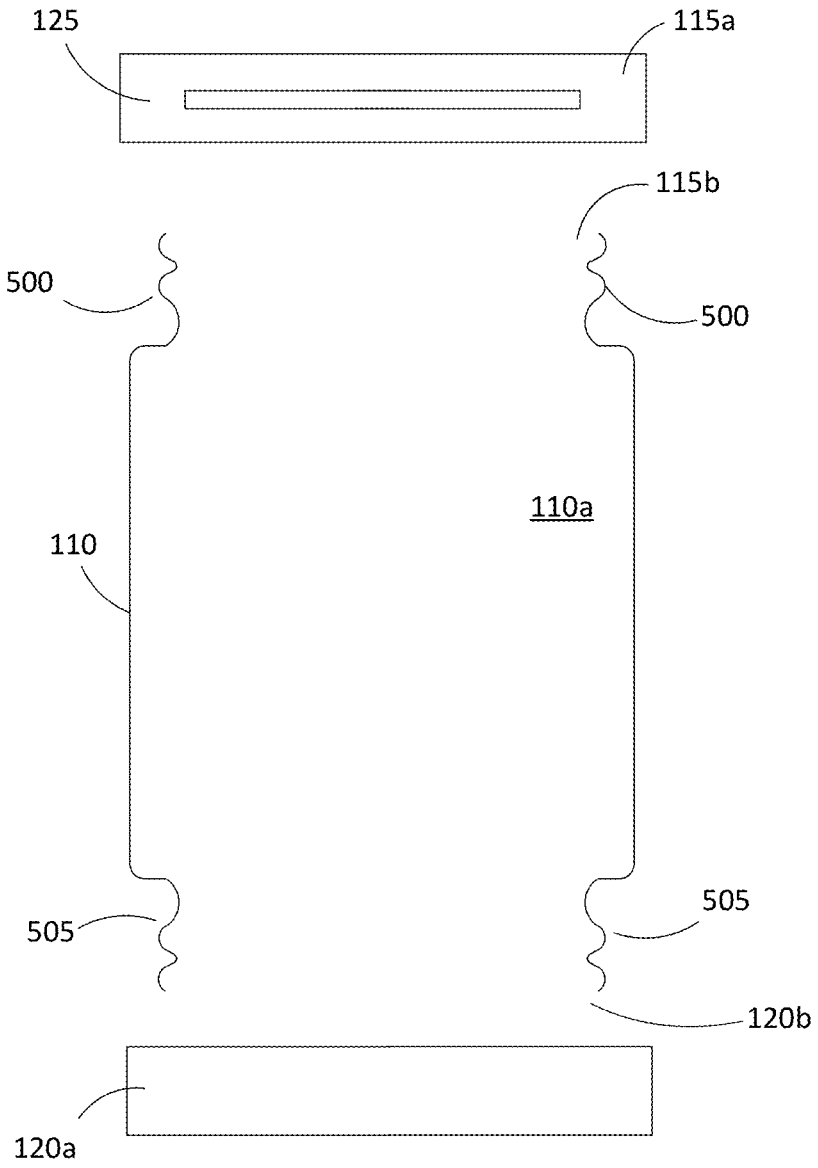
FIGS. 5A-5B depict exemplary double-ended container implementations.
Figure 5B:
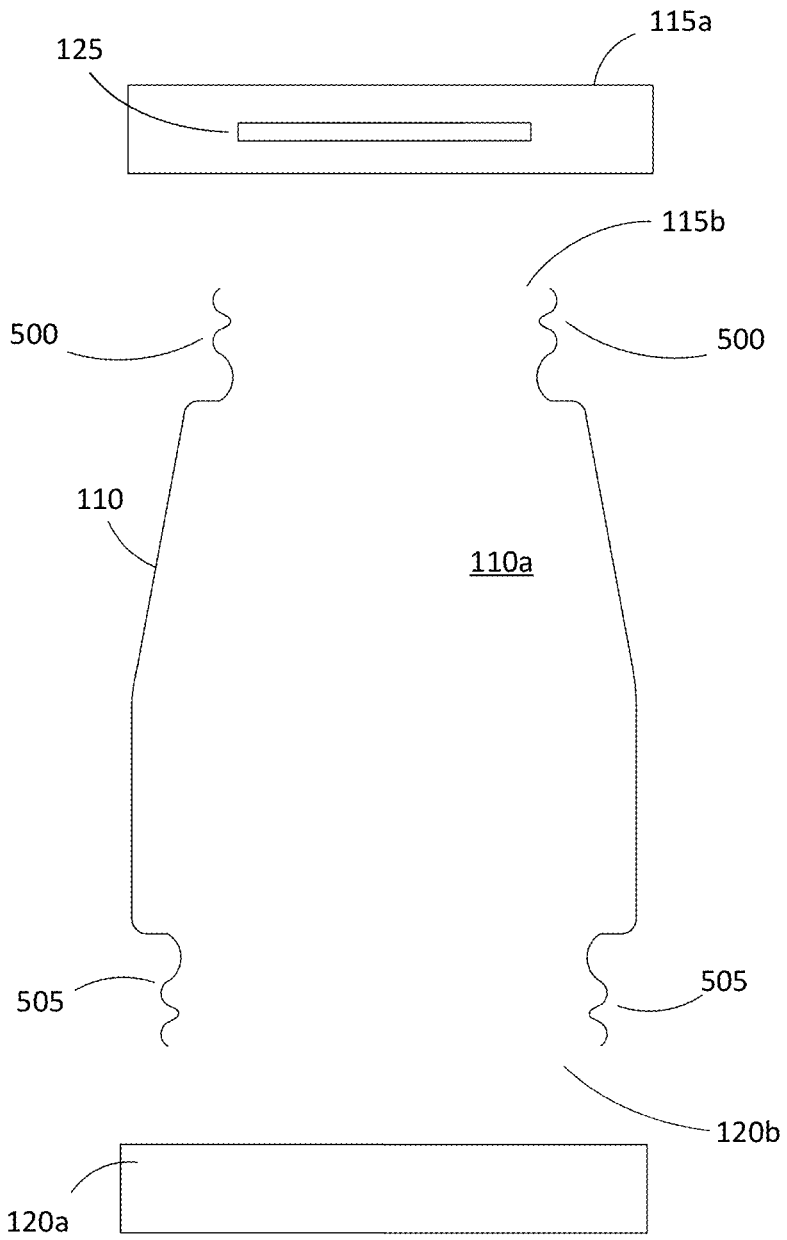

FIGS. 5A-5B depict exemplary double-ended container implementations. In FIGS. 5A-5B, the depicted exemplary double-ended containers 110 comprise the top opening threads 500 and the bottom opening threads 505. In the implementation depicted by FIG. 5A, the double-ended container 110 may be a peanut butter jar. In the implementation depicted by FIG. 5A, the double-ended container 110 may be a mayonnaise jar. In the implementation depicted by FIG. 5B, the double-ended container 110 may be a salad dressing bottle. In the implementation depicted by FIG. 5B, the double-ended container 110 may be a squeezable salad dressing bottle. In the implementation depicted by FIG. 5B, the double-ended container 110 may be a squeezable mayonnaise bottle. In the implementation depicted by FIG. 5B, the double-ended container 110 may be a squeezable ketchup or mustard bottle.

Implementation 1. An apparatus comprising: double-ended container (110) having a top opening (115*b*), a bottom opening (120*b*), an interior surface (110*a*), an exterior surface (110*b*) and a length separating the top opening (115*b*) from the bottom opening (120*b*); at least one groove disposed in the interior surface; a top removable lid (115*a*) configured to close the top opening (115*b*), the top removable lid (115*a*) configured to retain a removable insert (125); and a bottom removable lid (120*a*) configured to close the bottom opening (120*b*).

Implementation 2. The apparatus of implementation 1, wherein the removable insert (125) is a peelable insert (125).

Implementation 3. The apparatus of implementation 1, wherein the at least one groove is a spiral groove (300).

Implementation 4. The apparatus of implementation 3, wherein the removable insert (125) has at least one planar surface (125*b*) and an edge (125*a*) defining a perimeter of the at least one planar surface (125*b*), wherein the edge (125*a*) of the removable insert (125) fits within the spiral groove (300).

Implementation 5. The apparatus of implementation 3, wherein the removable insert (125) further comprises a collapsible surface tab (200) disposed on at least one planar surface (125*b*).

Implementation 6. The apparatus of implementation 1, wherein the at least one groove is a plurality of vertical grooves.

Implementation 7. The apparatus of implementation 6, wherein the plurality of vertical grooves extend from the top opening (115*b*) to the bottom opening (120*b*).

Implementation 8. The apparatus of implementation 6, wherein the removable insert (125) further comprises at least one planar surface (125*b*) and an edge (125*a*) defining a perimeter of the at least one planar surface (125*b*), and wherein a perimeter tab (205) disposed in the edge (125*a*) is configured to engage at least one groove of the plurality of vertical grooves (305).

Implementation 9. The apparatus of implementation 6, wherein the at least one groove (305) further comprises at least one slot (400) offset from a centerline of at least one groove of the plurality of vertical grooves (305).

Implementation 10. The apparatus of implementation 6, wherein the at least one groove (305) further comprises a plurality of slots (400) distributed along a length of at least one groove of the plurality of vertical grooves (305).

Implementation 11. An apparatus comprising: double-ended container (110) having a top opening (115*b*), a bottom opening (120*b*), an interior surface (110*a*), an exterior surface (110*b*) and a length separating the top opening (115*b*) from the bottom opening (120*b*); a top removable lid (115*a*) configured to close the top opening (115*b*), the top removable lid (115*a*) retaining a removable insert (125); and a bottom removable lid (120*a*) configured to close the bottom opening (120*b*).

Implementation 12. The apparatus of implementation 11, wherein the removable insert (125) is a peelable insert (125).

Implementation 13. The apparatus of implementation 11, wherein the apparatus further comprises at least one groove disposed in the interior surface.

Implementation 14. The apparatus of implementation 13, wherein the at least one groove is a spiral groove (300).

Implementation 15. The apparatus of implementation 14, wherein the removable insert (125) has an edge (125*a*) defining a perimeter of the removable insert (125) and the edge (125*a*) of the removable insert (125) fits within the at least one groove (300).

Implementation 16. The apparatus of implementation 13, wherein the removable insert (125) further comprises a collapsible surface tab (200) disposed on a planar surface (125*b*) of the removable insert (125).

Implementation 17. The apparatus of implementation 13, wherein the at least one groove is a plurality of vertical grooves.

Implementation 18. The apparatus of implementation 17, wherein the plurality of vertical grooves extend from the top opening (115*b*) to the bottom opening (120*b*).

Implementation 19. The apparatus of implementation 17, wherein the removable insert (125) further comprises at least one planar surface (125*b*) and an edge (125*a*) defining a perimeter of the at least one planar surface (125*b*), and wherein a perimeter tab (205) disposed in the edge (125*a*) is configured to engage at least one vertical groove.

Implementation 20. A method comprising: configuring a double-ended container (110) with a top opening (115*b*), a bottom opening (120*b*), an interior surface (110*a*), an exterior surface (110*b*) and a length separating the top opening (115*b*) from the bottom opening (120*b*); configuring at least one spiral groove (300) disposed in the interior surface; and configuring a removable lid to close the top opening (115*b*) and retain a peelable removable insert (125) having a collapsible surface tab (200) disposed on a planar surface (125*b*) of the peelable removable insert (125), wherein the peelable removable insert (125) has an edge (125*a*) that fits within the at least one spiral groove (300).

Implementation 21. A method comprising: configuring a double-ended container (110) with a top opening (115*b*), a bottom opening (120*b*), an interior surface (110*a*), an exterior surface (110*b*) and a length separating the top opening (115*b*) from the bottom opening (120*b*); configuring a top removable lid (115*a*) to close the top opening (115*b*) and retain a removable insert (125); and configuring a bottom removable lid (120*a*) to close the bottom opening (120*b*).

Implementation 22. An apparatus comprising: a refillable spread jar having a top, a bottom and an interior comprising a groove extending longitudinally from the top to the bottom of the spread jar; a removable lid mechanically connected to the top of the spread jar; a removable lid mechanically connected to the bottom of the spread jar; and a peelable insert configured within the removable lid connected to the top of the spread jar, wherein the peelable insert fits within the jar groove.

Implementation 23. The apparatus of implementation 22, wherein the peelable insert comprises a top, a bottom and a rigid collapsible tab mechanically attached to the top of the peelable insert.

Although various features have been described with reference to the Figures, other features are possible. For example, an exemplary insert may comprise a surface tab disposed on a top surface of the insert for use as a handle to rotate the insert guided by a spiral groove to force contents out of the bottom opening. The insert may comprise a perimeter tab disposed at a perimeter of the insert to engage a straight groove. Engaging the straight groove with the perimeter tab may prevent the insert from rotating within the container. The groove may comprise slots offset from a groove centerline, permitting the insert to be temporarily locked in slot positions between the top and bottom. The groove may extend longitudinally from the top opening to the bottom opening. The container may comprise a plurality of grooves. The top removable lid may removably retain an insert.

Disclosed herein are double-sided jars and lids for spreads, pastes and creams as a way to access, use all, and store condiments such as peanut butter, mayo, jelly, pastes and the like. A two-sided spread jar implementation may comprise a refillable spread jar having a top, a bottom and an interior comprising at least one groove extending longitudinally from the top to the bottom of the spread jar; a removable lid mechanically connected to the top of the spread jar; a removable lid mechanically connected to the bottom of the spread jar; and a peelable insert that fits within the removable lid connected to the top of the spread jar, wherein the peelable insert also fits within the jar groove. The peelable insert may comprise a top, a bottom and a rigid collapsible tab mechanically attached to the top of the peelable insert. The rigid collapsible tab may engage with a groove, to stabilize the insert's position perpendicular to the longitudinal axis of the jar. Stabilizing the insert's position perpendicular to the longitudinal axis of the jar by engaging the tab with a groove may maintain a larger surface area of the insert against the material content of the jar to maximize material removal efficiency.

In an illustrative example, when the spread is partially gone, the user may peel the removable insert from the primary lid and place the removable insert into the jar groove. Holding the rigid collapsible tab of the peelable insert, the user screws or turns the rigid peelable insert into the jar groove and pushes the jar contents toward the bottom of the jar lid. This action serves to scrape the side of the inside of the jar toward the bottom of the jar to ensure all of the spread is available to the user. In an illustrative example, the jar may then be flipped over. In such an example, the secondary or bottom lid may be the primary access for the user, providing easy access to the remaining contents of the jar within. This screw action can be repeated as often as necessary to force the contents of the jar toward the bottom.

An implementation of a two-sided spread jar may reduce a user's effort accessing spreads and condiments, permitting a user to simply flip the jar over and use the insert to force the contents out the other end of the jar for easy access to the remainder of the spread without making a mess. An exemplary two-sided jar may be implemented in any shape or size.

In illustrative examples, herein disclosed is a spread jar with a secondary lid at the bottom of a jar that creates a way to easily access the remaining spread without struggle, mess or food waste. Unused spread at the bottom of the jar will be avoided using a lid at the top and at the bottom. The double sided spread jar makes it easy to access spreads and condiments when over halfway through with the spread. The user no longer must stick their hand awkwardly into the container and create a mess. Moreover, there is less waste of food in the bottom of the container. Simply flip the jar over for easy access to the remainder of the spread, mess free. An implementation of the invention may eliminate food waste. This is increasingly important to stretching the consumer dollar in a world of high grocery costs and consumer goods. This device ensures that the user gets every penny out of their purchase. The lid on the bottom of the jar may be a direct replica of the lid at the top of the jar. The consumer simply needs to flip the jar over once the spread is running low. In one embodiment, the primary lid has a rigid peelable insert that fits within the jar. When the spread is partially gone, the user peels the removable insert from the primary lid, inserts it into the jar and pushes the spread toward the bottom of the jar. The inside of the jar has grooves on the interior. So, the rigid peelable insert can be screwed through the interior of the jar thereby scraping the sides of the inside of the jar to ensure all of the spread is pushed toward the bottom of the jar. The rigid peelable insert locks in place within the grooves of the jar. The jar is then flipped over. The secondary or bottom lid provides easy access to the food content of the jar within.

In another embodiment, the rigid peelable insert may be used to push the contents of the jar from the bottom of the container toward the top of the container. An exemplary double-sided spread jar implementation may achieve one or more technical effects such as for example: 1) increased food efficiency, i.e. less food waste; 2) less mess from food product on the users' hands; and improved sanitary handling of food by avoiding unnecessary contact with potentially unclean hands. In one embodiment, this device could be adapted for use with glass jars or tubes of paste by employing double sided screws on glass jars or tube caps. In one embodiment the tubes or jars may be made of plastic.

In the Summary above and in this Detailed Description, and the Claims below, and in the accompanying drawings, reference is made to particular features of various implementations. It is to be understood that the disclosure of particular features of various implementations in this specification is to be interpreted to include all possible combinations of such particular features. For example, where a particular feature is disclosed in the context of a particular aspect or implementation, or a particular claim, that feature can also be used—to the extent possible—in combination with and/or in the context of other particular aspects and implementations, and in an implementation generally.

While multiple implementations are disclosed, still other implementations will become apparent to those skilled in the art from this detailed description. Disclosed implementations may be capable of myriad modifications in various obvious aspects, all without departing from the spirit and scope of the disclosed implementations. Accordingly, the drawings and descriptions are to be regarded as illustrative in nature and not restrictive.

It should be noted that the features illustrated in the drawings are not necessarily drawn to scale, and features of one implementation may be employed with other implementations as the skilled artisan would recognize, even if not explicitly stated herein. Descriptions of well-known components and processing techniques may be omitted so as to not unnecessarily obscure the implementation features.

In the present disclosure, various features may be described as being optional, for example, through the use of the verb "may;" or, through the use of any of the phrases: "in some implementations," "in some designs," "in various implementations," "in various designs," "in an illustrative example," or, "for example." For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be implemented in seven different ways, namely with just one of the three possible features, with any two of the three possible features or with all three of the three possible features.

In various implementations, elements described herein as coupled or connected may have an effectual relationship realizable by a direct connection or indirectly with one or more other intervening elements.

In the present disclosure, the term "any" may be understood as designating any number of the respective elements, i.e. as designating one, at least one, at least two, each or all of the respective elements. Similarly, the term "any" may be understood as designating any collection(s) of the respective elements, i.e. as designating one or more collections of the respective elements, a collection comprising one, at least one, at least two, each or all of the respective elements. The respective collections need not comprise the same number of elements.

While various implementations have been disclosed and described in detail herein, it will be apparent to those skilled in the art that various changes may be made to the disclosed configuration, operation, and form without departing from the spirit and scope thereof. In particular, it is noted that the respective implementation features, even those disclosed solely in combination with other implementation features, may be combined in any configuration excepting those readily apparent to the person skilled in the art as nonsensical. Likewise, use of the singular and plural is solely for the sake of illustration and is not to be interpreted as limiting.

The Abstract is provided to comply with 37 C. F. R. § 1.72(b), to allow the reader to quickly ascertain the nature of the technical disclosure and is submitted with the understanding that it will not be used to interpret or limit the scope or meaning of the claims.

In the present disclosure, any method or apparatus implementation may be devoid of one or more process steps or components. In the present disclosure, implementations employing negative limitations are expressly disclosed and considered a part of this disclosure.

Certain terminology and derivations thereof may be used in the present disclosure for convenience in reference only and will not be limiting. For example, words such as "top," "bottom," "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "comprises" and grammatical equivalents thereof are used herein to mean that other components, ingredients, steps, among others, may be optionally present. For example, an implementation "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Many suitable methods and corresponding materials to make each of the individual parts of implementation apparatus are known in the art. One or more implementation part may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as may be described hereinabove may be used. Many suitable materials are known and available and can be selected and mixed depending on desired strength and flexibility, preferred manufacturing method and particular use, as will be apparent to a person of ordinary skill in the art.

Any element in a claim herein that does not explicitly state "means for" performing a specified function, or "step for" performing a specific function, is not to be interpreted as a "means" or "step" clause as specified in 35 U.S.C. § 112 (f). Specifically, any use of "step of" in the claims herein is not intended to invoke the provisions of 35 U.S.C. § 112 (f). Elements recited in means-plus-function format are intended to be construed in accordance with 35 U.S.C. § 112 (f).

Recitation in a claim of the term "first" with respect to a feature or element does not necessarily imply the existence of a second or additional such feature or element.

The phrases "connected to," "coupled to" and "in communication with" refer to any form of interaction between two or more entities, including mechanical, electrical, magnetic, electromagnetic, fluid, and thermal interaction. Two components may be functionally coupled to each other even though they are not in direct contact with each other. The terms "abutting" or "in mechanical union" refer to items that are in direct physical contact with each other, although the items may not necessarily be attached together.

The word "exemplary" is used herein to mean "serving as an example, instance, or illustration." Any implementation described herein as "exemplary" is not necessarily to be construed as preferred over other implementations. While various aspects of the disclosure are presented with reference to drawings, the drawings are not necessarily drawn to scale unless specifically indicated.

Reference throughout this specification to "an implementation" or "the implementation" means that a particular feature, structure, or characteristic described in connection with that implementation is included in at least one implementation. Thus, the quoted phrases, or variations thereof, as recited throughout this specification are not necessarily all referring to the same implementation.

Similarly, it should be appreciated that in the above description, various features are sometimes grouped together in a single implementation, Figure, or description thereof for the purpose of streamlining the disclosure. This method of disclosure, however, is not to be interpreted as reflecting an intention that any claim in this or any application claiming priority to this application require more features than those expressly recited in that claim. Rather, as the following claims reflect, inventive aspects may lie in a combination of fewer than all features of any single foregoing disclosed implementation. Thus, the claims following this Detailed Description are hereby expressly incorporated into this Detailed Description, with each claim standing on its own as a separate implementation. This disclosure is intended to be interpreted as including all permutations of the independent claims with their dependent claims.

The element descriptions and their respective reference characters used in the Drawings are summarized as follows.

operational scenario 100
double-ended container 110
double-ended container interior surface 110*a*
double-ended container exterior surface 110*b*
top removable lid 115*a*
top opening 115*b*
bottom removable lid 120*a*
bottom opening 120*b*
insert 125
insert edge 125*a*
insert planar surface 125*b*
utensil 130
initial spread level 135
depleted spread level 140
surface tab 200
perimeter tab 205
spiral groove 300
straight groove 305
rotation 310
slot 400
top opening threads 500
bottom opening threads 505

A number of implementations have been described. Nevertheless, it will be understood that various modifications may be made. For example, the steps of the disclosed techniques may be performed in a different sequence, components of the disclosed systems may be combined in a different manner, or the components may be supplemented with other components. Accordingly, other implementations are contemplated, within the scope of the following claims.

What is claimed is:

1. An apparatus comprising:

double-ended container (110) having a top opening (115*b*), a bottom opening (120*b*), an interior surface (110*a*), an exterior surface (110*b*) and a length separating the top opening (115*b*) from the bottom opening (120*b*);

at least one spiral groove (300) disposed in the interior surface (110*a*);

a top removable lid (115*a*) configured to close the top opening (115*b*), the top removable lid (115*a*) configured to retain a removable insert (125) comprising a collapsible surface tab (200) disposed on at least one planar surface (125*b*), wherein the collapsible surface tab (200) is configured to extend above the at least one planar surface (125*b*); and a bottom removable lid (120*a*) configured to close the bottom opening (120*b*).

2. The apparatus of claim 1, wherein the removable insert (125) is a peelable insert (125) retained by the top removable lid (115*a*).

3. The apparatus of claim 1, wherein the removable insert (125) has at least one planar surface (125*b*) and an edge (125*a*) defining a perimeter of the at least one planar surface (125*b*), wherein the edge (125*a*) of the removable insert (125) fits within the at least one spiral groove (300).

4. The apparatus of claim 1, wherein the at least one spiral groove (300) is a plurality of vertical grooves (305).

5. The apparatus of claim 4, wherein the plurality of vertical grooves (305) extend from the top opening (115*b*) to the bottom opening (120*b*).

6. The apparatus of claim 4, wherein the removable insert (125) further comprises at least one planar surface (125*b*) and an edge (125*a*) defining a perimeter of the at least one planar surface (125*b*), and wherein a perimeter tab (205) disposed in the edge (125*a*) is configured to engage the at least one spiral groove (300) of the plurality of vertical grooves (305).

7. The apparatus of claim 4, wherein the at least one spiral groove (300) further comprises at least one slot (400) offset from a centerline of the at least one spiral groove (300) of the plurality of vertical grooves (305).

8. The apparatus of claim 4, wherein the at least one spiral groove (300) further comprises a plurality of slots (400) distributed along a length of the at least one spiral groove (300) of the plurality of vertical grooves (305).

9. An apparatus comprising:

double-ended container (110) having a top opening (115*b*), a bottom opening (120*b*), an interior surface (110*a*), an exterior surface (110*b*) and a length separating the top opening (115*b*) from the bottom opening (120*b*);

at least one groove disposed in the interior surface;

a top removable lid (115*a*) configured to close the top opening (115*b*), the top removable lid (115*a*) retaining a removable insert (125) comprising a collapsible surface tab (200) disposed on a planar surface (125*b*) of the removable insert (125), wherein the collapsible surface tab (200) is configured to extend above the planar surface (125*b*) and;

a bottom removable lid (120*a*) configured to close the bottom opening (120*b*).

10. The apparatus of claim 9, wherein the removable insert (125) is a peelable insert (125) retained by the top removable lid (115*a*).

11. The apparatus of claim 9, wherein the at least one groove is a spiral groove (300).

12. The apparatus of claim 11, wherein the removable insert (125) has an edge (125*a*) defining a perimeter of the removable insert (125) and the edge (125*a*) of the removable insert (125) fits within the at least one groove (300).

13. The apparatus of claim 9, wherein the at least one groove is a plurality of vertical grooves.

14. The apparatus of claim 13, wherein the plurality of vertical grooves extend from the top opening (115*b*) to the bottom opening (120*b*).

15. The apparatus of claim 13, wherein the removable insert (125) further comprises at least one planar surface (125*b*) and an edge (125*a*) defining a perimeter of the at least one planar surface (125*b*), and wherein a perimeter tab (205) disposed in the edge (125*a*) is configured to engage at least one vertical groove.

16. A method comprising:

configuring a double-ended container (110) with a top opening (115*b*), a bottom opening (120*b*), an interior surface (110*a*), an exterior surface (110*b*) and a length separating the top opening (115*b*) from the bottom opening (120*b*);

configuring at least one spiral groove (300) disposed in the interior surface; and configuring a removable lid to close the top opening (115*b*) and retain a peelable removable insert (125) having a collapsible surface tab (200) disposed on a planar surface (125*b*) of the peelable removable insert (125), wherein the peelable removable insert (125) has an edge (125*a*) that fits within the at least one spiral groove (300), wherein the collapsible surface tab (200) is configured to extend above the planar surface (125*b*).

* * * * *